United States Patent [19]

Kikuchi et al.

[11] Patent Number: 5,036,168

[45] Date of Patent: Jul. 30, 1991

[54] MULTI-UNIT SWITCH ASSEMBLY

[75] Inventors: Atsushi Kikuchi; Yoshiyuki Tatsuo, both of Obihiro, Japan

[73] Assignee: Matsushita Electric Works, Ltd., Japan

[21] Appl. No.: 401,233

[22] Filed: Aug. 31, 1989

[30] Foreign Application Priority Data

Sep. 9, 1988 [JP] Japan ..... 63-227223

[51] Int. Cl.[5] ..... H01H 9/02

[52] U.S. Cl. ..... 200/5 R; 200/295; 200/315; 174/53

[58] Field of Search ..... 200/5 R, 5 A, 315, 339, 200/294–296; 174/52.1, 53, 54, 55, 58, 66, 67; 361/331

[56] References Cited

U.S. PATENT DOCUMENTS

| | | | |
|---|---|---|---|
| 3,562,468 | 2/1971 | Stefani | 200/295 |
| 3,651,296 | 3/1972 | Yarbrough | 200/315 |
| 3,684,847 | 8/1972 | Hoehn et al. | 200/315 X |
| 4,172,973 | 10/1979 | Sano | 200/315 |
| 4,710,602 | 12/1987 | Baity et al. | 200/315 |
| 4,778,967 | 10/1988 | Deng | 200/315 |
| 4,857,669 | 8/1989 | Kitamura et al. | 200/296 X |

*Primary Examiner*—J. R. Scott

*Attorney, Agent, or Firm*—Stevens, Davis, Miller & Mosher

[57] ABSTRACT

A multi-unit switch assembly has a single housing which is divided into a plurality of compartment for respectively accommodating therein a corresponding number of switch mechanisms. Each switch mechanism includes contacts and an actuator rockable within the housing for closing and opening the contacts. Each of the actuators is provided with a spring catch for detachable snap connection with each of operator handles which correspond in number to the number of the switch mechanisms and positioned exteriorly of the housing and thus rockable together with the corresponding actuators for contact closing and opening of the individual switch mechanisms. With the detachable connection of the handle and the actuator in each switch mechanism within the housing, the housing may be mounted to a wall or a like supporting surface prior to assembling the operator handle to the housing. An indicator lamp for showing the switch position is mounted in the housing and transparent portions on the actuator and operator handles permit viewing thereof.

7 Claims, 10 Drawing Sheets

MULTI-UNIT SWITCH ASSEMBLY

BACKGROUND OF THE INVENTION

1. Field of the Invention

The present invention is directed to a multi-unit switch assembly, and more particularly to a wall-mounted switch assembly having a number of switch mechanisms and respective operator handles for actuating the individual switch mechanisms to control, for example, individual lighting circuits.

2. Description of the Prior Art

There have been proposed in the art a number of multiunit switch assembly in which a number of separate switch modules are held together on a mount bracket, for example, as shown in U.S. Pat. No. 3,562,468. As apparent from the prior switch assembly, the individual switch modules require separate housings for accommodating the individual switch mechanisms. These housings will be duplicate members when two or more switches are utilized on the common mount bracket and consequently occupy a correspondingly large space. Further, since the individual switch modules are to be independently mounted on the mount bracket, it is likely to fail to exactly align the switch modules, particularly operator handles thereof, which may result in jamming of the operator handles to each other when the switch modules are arranged closely to each other and therefore greatly reduce operability of the switch handles, in addition to that the handle disarrangement may give an aesthetically unpleasant appearance. Accordingly, the multi-unit switch assembly is mostly desired to have less duplicate members, to occupy less space, and to have exact alignment of the operator handles.

SUMMARY OF THE INVENTION

The above problem has been eliminated in the present invention which provides a multi-unit switch assembly of unique configuration. The multi-unit switch assembly in accordance with the present invention comprises a single housing which is divided into a plurality of compartments respectively accommodating therein a corresponding number of switch mechanisms. Each of the switch mechanisms includes an individual switch contact and an actuator rockable within the housing for closing and opening the contact. A corresponding number of operator handles are detachably connected respectively to the actuators by means of spring catches which effect snap connection between each of the actuators and the operator handles so that the operator handles are rockable together with the corresponding actuators for contact opening and closing. Due to the provision of a single housing for accommodating the plural switching mechanisms, it is not necessary to provide individual housings for each of the plural switch mechanisms, thereby eliminating duplicate members and reducing the size of the entire switch assembly. Also with this arrangement, the switch mechanisms and the operator handles thereof can be exactly arranged in a predetermined relation with respect to the single housing, thereby eliminating an undesirable disarrangement of the operator handles which would be otherwise possible if individual switch mechanisms are accommodated respectively in separate housings which are required to be independently mounted on a mount bracket or the like support member. With this exact arrangement of the operator handles, the operator handles can be free from jamming even when they are closely positioned to each other, in addition to that they can have an aesthetically pleasing appearance. Further, because the operator handles are each detachably connected to each of the actuators of the switch mechanisms by snap connection with the spring catch of the actuator, the operator handles can be last assembled when the switch assembly is installed on a wall or the like support surface together with an associated wall or face plate. This means that the housing of the switch assembly is permitted to be mounted to the wall together with a suitable face plate prior to being connected to the operator handles, which can reduce a structural restriction between the operator handles and the face plate and which in turn increases design flexibility both for the operator handles and the face plate in view of aesthetic considerations.

Accordingly, it is a primary object of the present invention to provide a multi-unit switch assembly which is capable of being made compact requiring less installation space as well as of assuring exact arrangement of the operator handles, yet advantageous for providing aesthetic appeal.

In a preferred embodiment, the operator handles are each in the form of a flat wide plate and arranged in a closely adjacent relation such that the operator handles can conceal the housing and the switch mechanisms therebehind while exposing only the operator handles, which is therefore another object of the present invention.

At least one of the switch mechanisms includes an indicator lamp indicating a particular condition of an electric circuit connected to the switch contact. The indicator lamp is located below the actuator and the spring catch. The associated operator handle is formed at the connection to the actuator with a transparent window such that the lamp can be viewed through the actuator, the catch spring, and the transparent window for confirmation of the condition of the circuit.

It is therefore a further object of the present invention to provide a multi-unit switch assembly in which an indicator lamp received in the switch mechanisms can be viewed through a transparent window provided at the connecting portion of the operator handle to the actuator.

For establishing a viewing path from the indicator lamp to the transparent window of the operator handle, the actuator is provided in the form of a top-opened rectangular frame having opposed side walls, opposed end walls, and a bottom wall with a transparent portion, while on the other hand the spring catch is formed into a U-shaped configuration with a pair of catch legs connected by a horizontal member with an opening. Thus, the light from the indicator lamp can be directed through the opening of the spring catch, the transparent bottom of the actuator and through the transparent window of the operator handle. Each of the catch legs is formed with a dent for engagement with a corresponding projection of the operator handle, and is given resiliency by which a detachable snap connection is made between the projection of the operator handle and the recess of the spring catch.

It is therefore a further object of the present invention to provide a multi-unit switch assembly which utilizes the actuators and the spring catches of particularly designed configurations for allowing the indicator lamp to be viewed through the actuator and spring catch and through the operator handle, while effecting detachable snap connection between the operator handle and the actuator.

The housing is preferably composed of a base body and a top cover which accommodate respectively the contacts and actuators. The base body and top cover are secured together by the use of a mount bracket which is adapted to be fixed to a wall surface for installation of the switch assembly. The mount bracket is placed over the top cover and is secured by screws to the base body so as to hold therebetween the top cover with the individual actuators exposed through the mount bracket for detachable connection to the operator handles. Thus, the switch assembly is provided as including the mount bracket for easy installation of the switch assembly, which is therefore a further object of the present invention.

These and still other objects and advantages of the present invention will become more apparent from the following description of the preferred embodiment when taken in conjunction with the attached drawings.

DESCRIPTION OF THE PREFERRED EMBODIMENT

Figure 1:
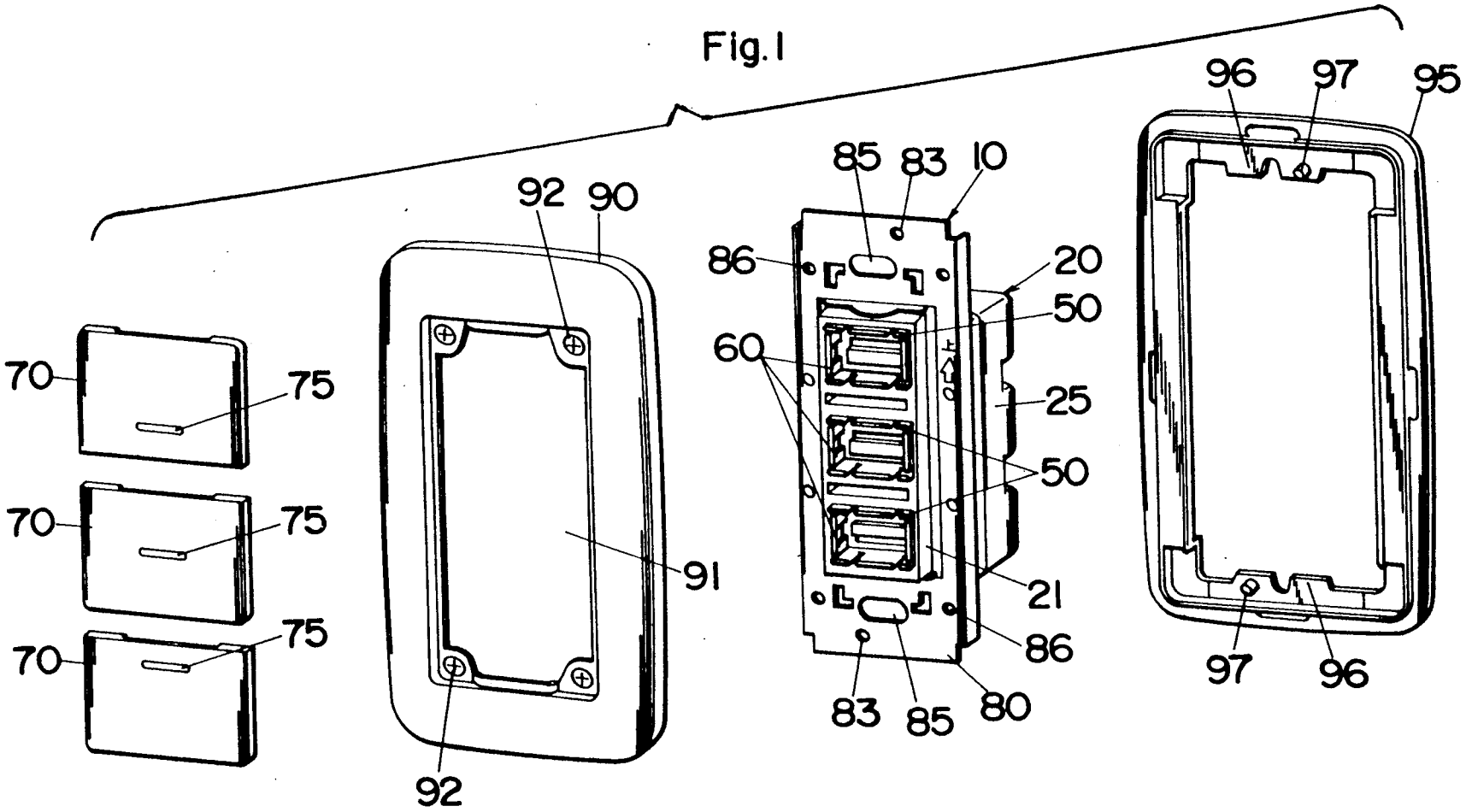
FIG. 1 is an exploded perspective view, shown together with an associated cover plate assembly, of a multi-unit switch assembly in accordance with a preferred embodiment of the present invention.
Figure 13:
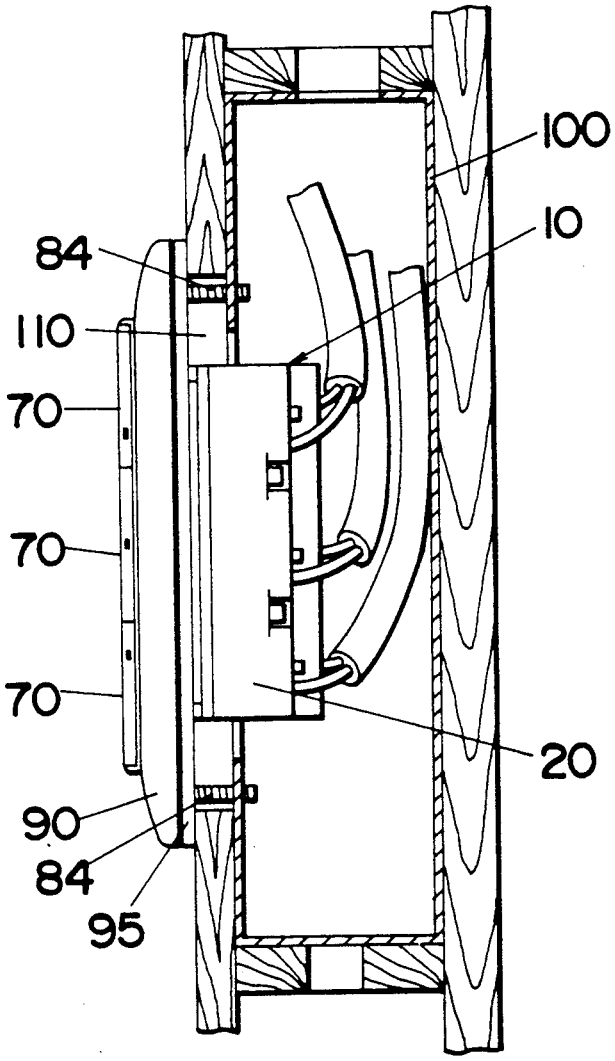
FIG. 13 is a view illustrating an installation of the switch assembly with the cover assembly to a wall.

Referring to FIG. 1, there is shown a multi-unit switch assembly of the present invention which is adapted to be mounted on a wall together with a cover plate assembly composed of a face plate 90 and a plate frame 95. The switch assembly 10 comprises a single housing 20 accommodating therein three separate switch mechanisms and three separate detachable operator handles 70. The housing 20 comprises a rectangular base body 25 and a correspondingly shaped top cover 21 which are both made of plastic material and are secured together by means of screws 29 extending through the base body 25 and the top cover to be threaded into corresponding holes 82 of a mount bracket 80 placed over the top cover 21. The mount bracket 80 is made from a metal stamping to have a window 81 through which a raised center portion 22 extend, and which is in use placed over the plate frame 95, and is then secured, for example, as shown in FIG. 13, by screws 84 to a wiring box 100 installed in a wall opening 110 so that the switch assembly 10 has its front portion only positioned forwardly of the wall opening 110 while the plate frame 95 surrounds the wall opening 110. The mount bracket 80 is formed in upper and lower end portions respectively with elongate holes 85 through which the screws 84 extend for connection to the wiring box 100. The plate frame 95 is formed with upper and lower flanges 96 extending inwardly to receive thereon the upper and lower portions of the mount bracket 80 with posts 97 on the flange 96 engaged respectively in corresponding holes 83 in the upper and lower portions of the mount bracket 80.

Figure 5:
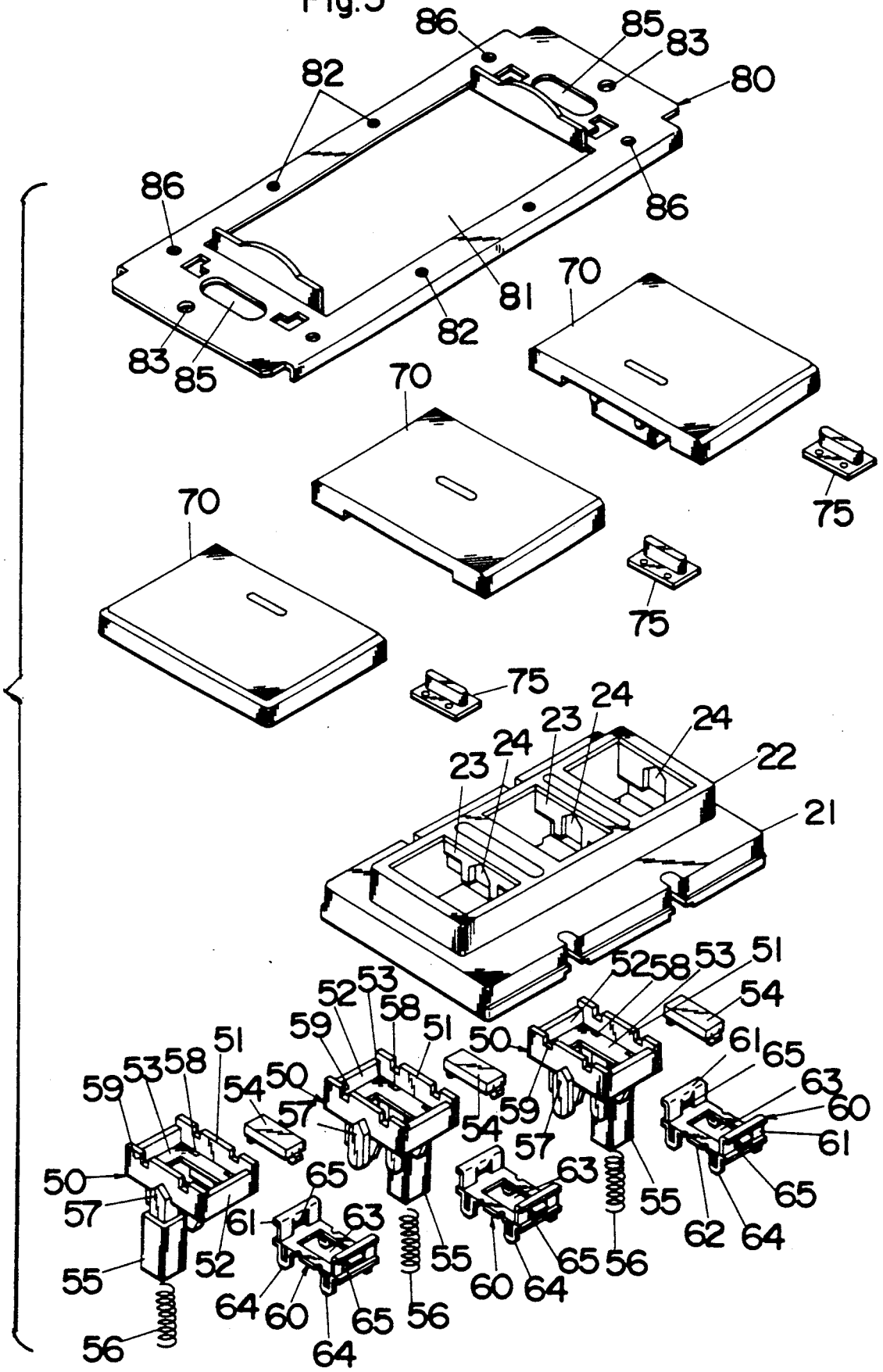
FIG. 5 is an exploded perspective view of the above switch assembly with its bottom portion removed.
Figure 6:
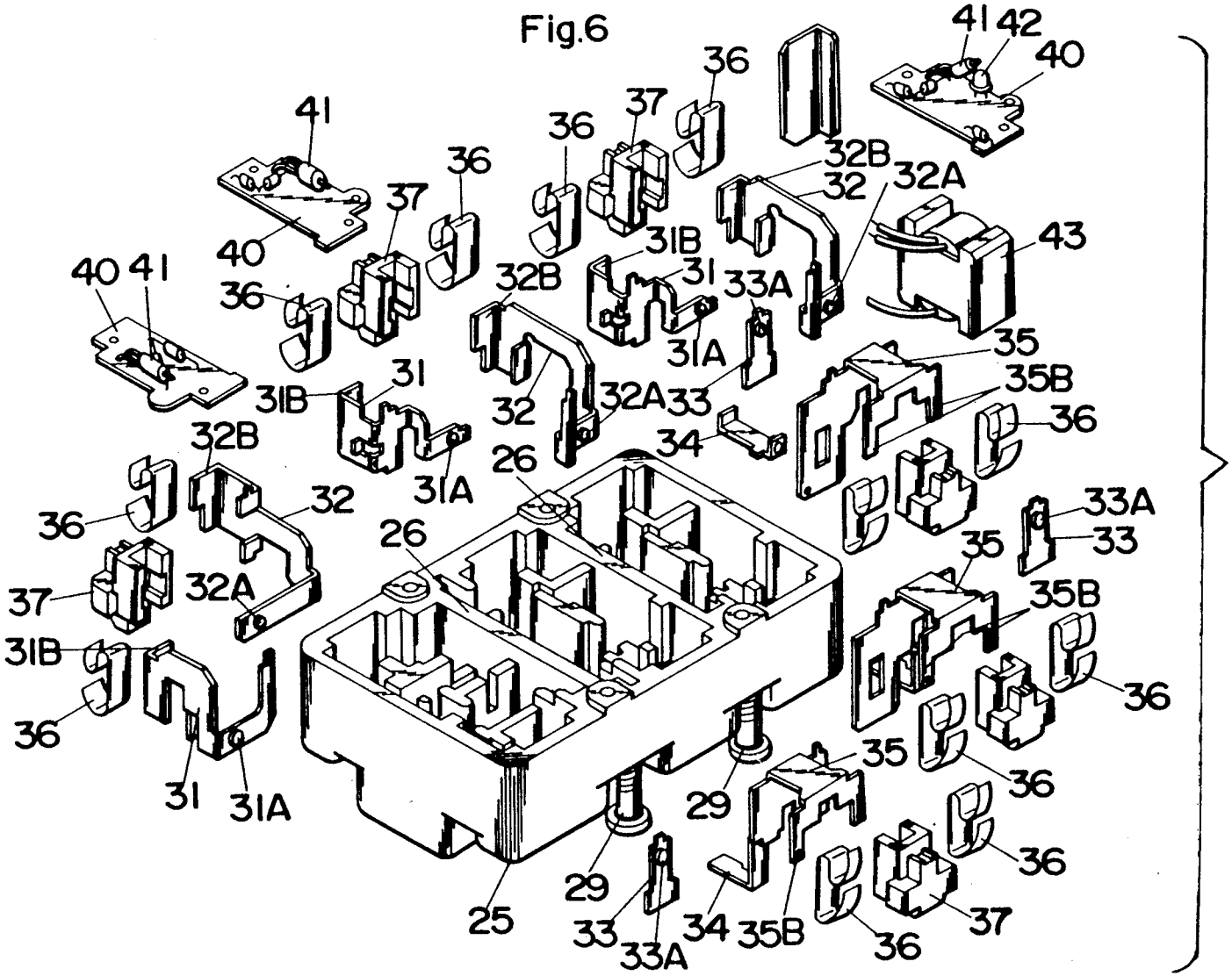
FIG. 6 is an exploded perspective view of the bottom portion of the above switch assembly.
Figure 7:
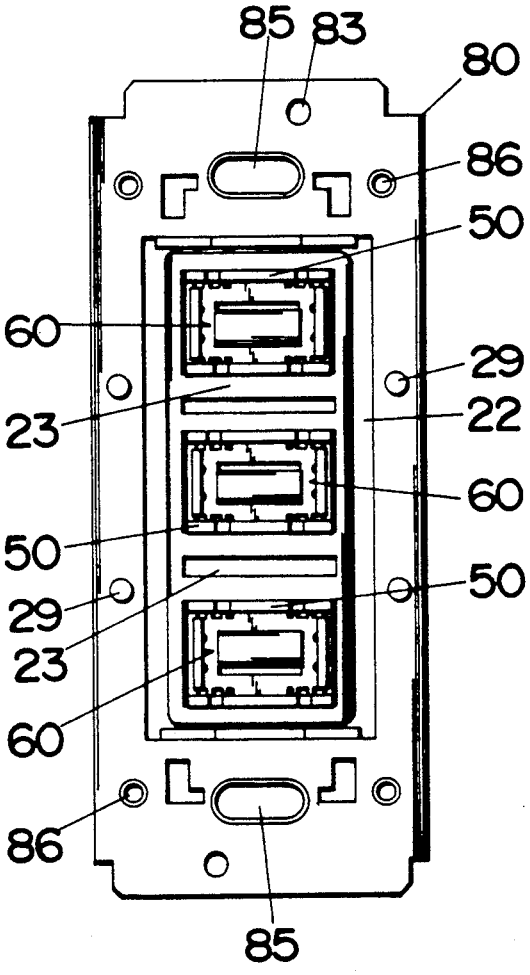
FIG. 7 is a front view of the switch assembly with operator handles removed.
Figure 8:
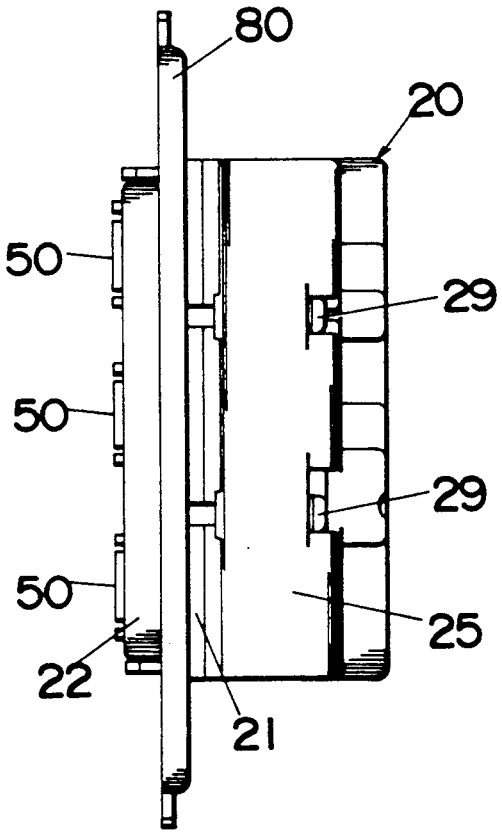
FIG. 8 is a side view of the switch assembly with the operator handles removed.
Figure 12:
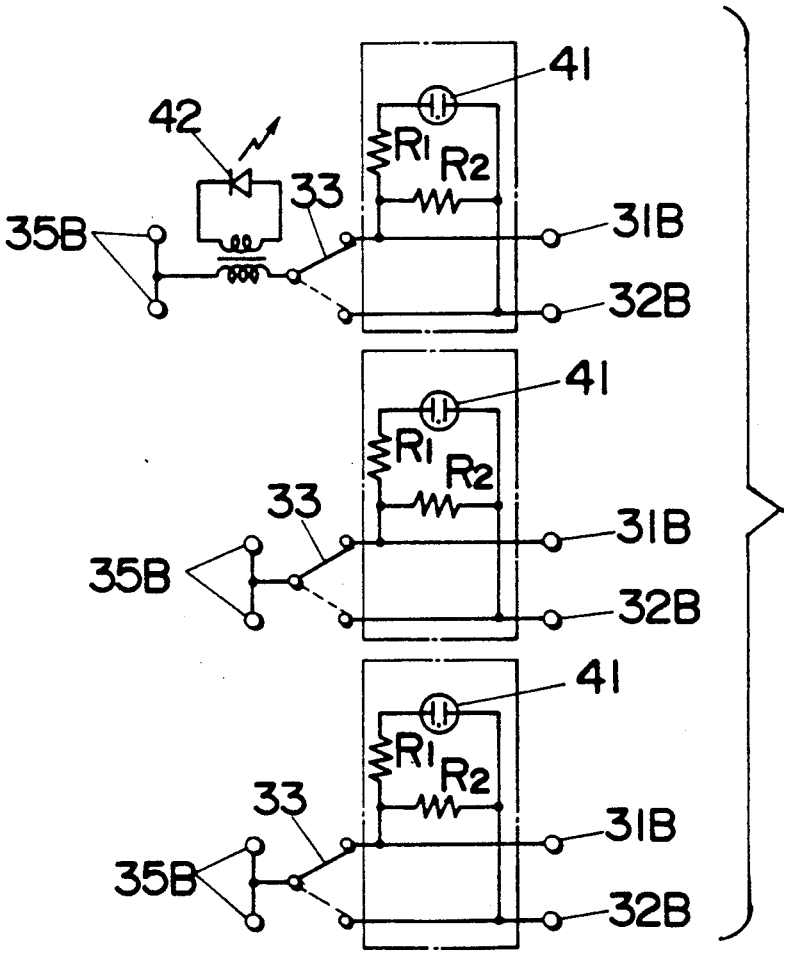
FIG. 12 is an internal wiring diagram of the switch assembly.

As shown in FIG. 6, the base body 25 is divided by integral partitions 26 into three compartments each receiving switch contacts and associated components of each switch mechanisms. Likewise, as shown in FIG. 5, the top cover 21 is divided by integral cross walls 23 into three sections each receiving actuator 50 of each of the three switch mechanisms. The actuator 50 is operatively connected to the contacts and is rockable within the top cover 21 between two contact operating positions. The switch contacts of each switch mechanism includes a pair of first and second stationary contact members 31 and 32 with respective contact pieces 31A and 32A, and a movable contact bar 33 with contact pieces 33A on the opposite sides. The movable contact bar 33 is pivotally supported at its lower end on a horizontal segment 34 which is formed integrally with or separately from a common terminal member 35 with a pair of terminal tongues 35B defining common terminals. The movable contact bar 33 is thus electrically connected through the segment 34 to the common terminal member 35 and is driven by the actuator 50 for pivotal movement between the first and second contact pieces 31A and 32A. Also formed respectively with the first and second contact members 31 and 32 are terminal tongues 31B and 32B which define first and second terminals, respectively. A grip spring 36 is received in the base body 25 in association with each of the terminals tongues 31B, 32B, and 35B to form a terminal grip for connection with an individual electrical cord or wire which is to be introduced through an individual port 27 in the bottom of the base body 25. A release slider 37 is positioned adjacent each grip spring 36 in such a relation that the release slider 37 acts to slacken the grip spring 36 when it is forced upwardly by an external tool, such as the tip of a screwdriver inserted through an individual slot 28 in the bottom of the base body 25. All these members 31 to 37 of each switch mechanism ar received in each separate compartment of the base body 25 together with a printed board 40 with an indicator lamp 41. The indicator lamp 41 is a neon lamp which is, as shown in FIG. 12, connected across the first and second terminal 31B and 32B with suitable resistors R1 and R2. The first and second terminals 31D and 32B are adapted to be selectively connected to a load directly or through another switch while the common terminal 35B is connected to a power source. Thus, the indicator lamp 41 can be turned on when the load connected to either of the first and second terminals 31B and 32B is deenergized. One of the switch mechanisms additionally includes on the printed board 40 a light emitting diode (LED) 42 coupled to the common terminal member 35 through a current transformer 43 so that the LED 42 is turned on when the load is energized. Each printed board 40 is located in the upper end portion in the corresponding compartment of the base body 25 in a horizontally offset position with respect to the movable contact bar 33 so as to permit the movable contact bar 33 connected to the actuator 50 without being interfered with the printed board 40.

Figure 9:
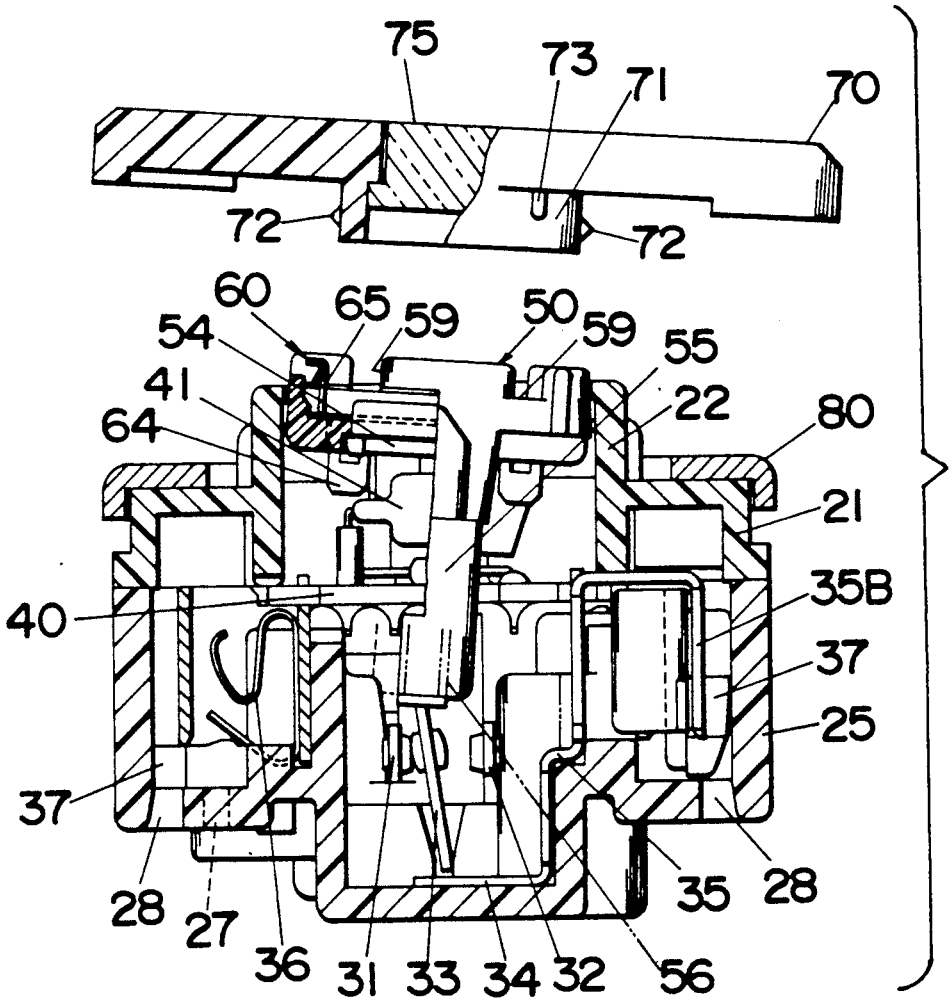
FIG. 9 is a sectional view of the switch assembly with the operator handles detached.
Figure 10:
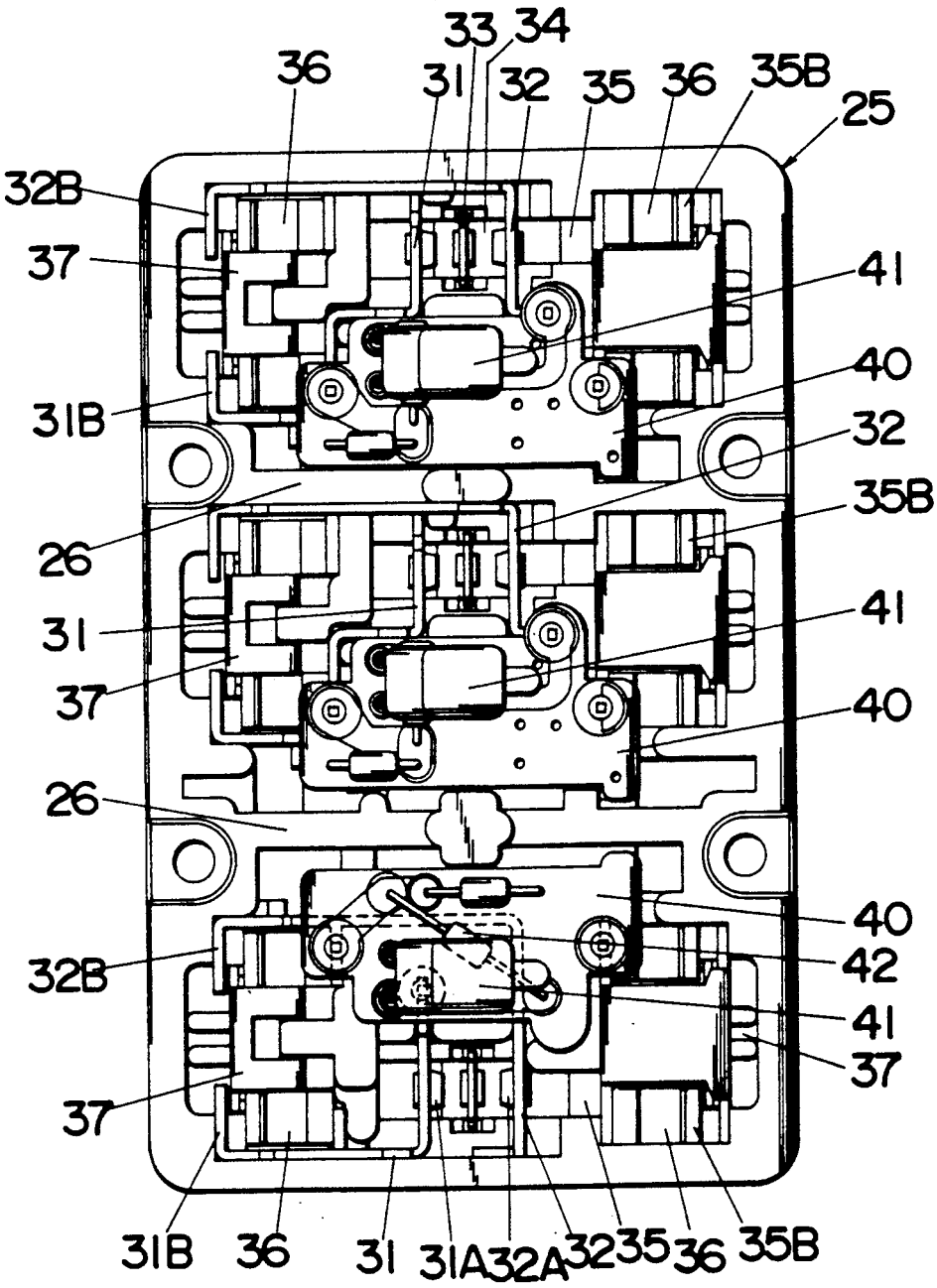
FIG. 10 is a top view of the switch assembly with the operator handles and associated actuators removed.
Figure 11:
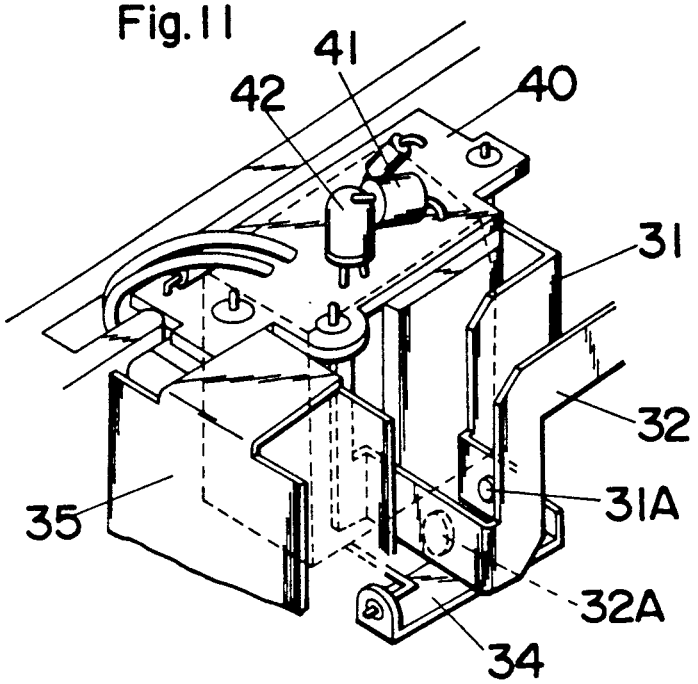
FIG. 11 is a perspective view of a contact portion of one switch mechanism of the switch assembly.

The actuator 50 is made from a plastic material and, as shown in FIGS. 5 and 9, comprises a top-opened rectangular frame having opposed side walls 51, opposed end walls 52, and a bottom 53 with a transparent plate 54 in its center, the rectangular frame being dimensioned to fit into each of the three sections formed interiorly of the top cover 21. Integrally extending downwardly from the bottom 53 of each actuator 50 is a hollow stem 55 which is offset laterally from the transparent plate 54 and receives therein an over-center spring 56, which in turn receives the top end of the movable contact bar 33. Formed on the opposite side walls 51 of the actuator 50 are pivot projections 57 which are respectively seated in corresponding recesses 24 in the side walls of each sections of the top cover 21 such that the actuator 50 is rockable with an upper pointed end of each projection 57 pivotally supported at a correspondingly pointed end of each recess 24. It is noted at this time that the over-center spring 56 acts to urge the actuator 50 upwardly to retain the actuator 50 exactly in a predetermined position within the top cover 21. The rocking movement of the actuator 50 is transmitted through the over-center spring 56 to move the contact bar 33 in an over-center manner between the first and second contact pieces 31A and 32A for contact closure and opening.

Figure 2:
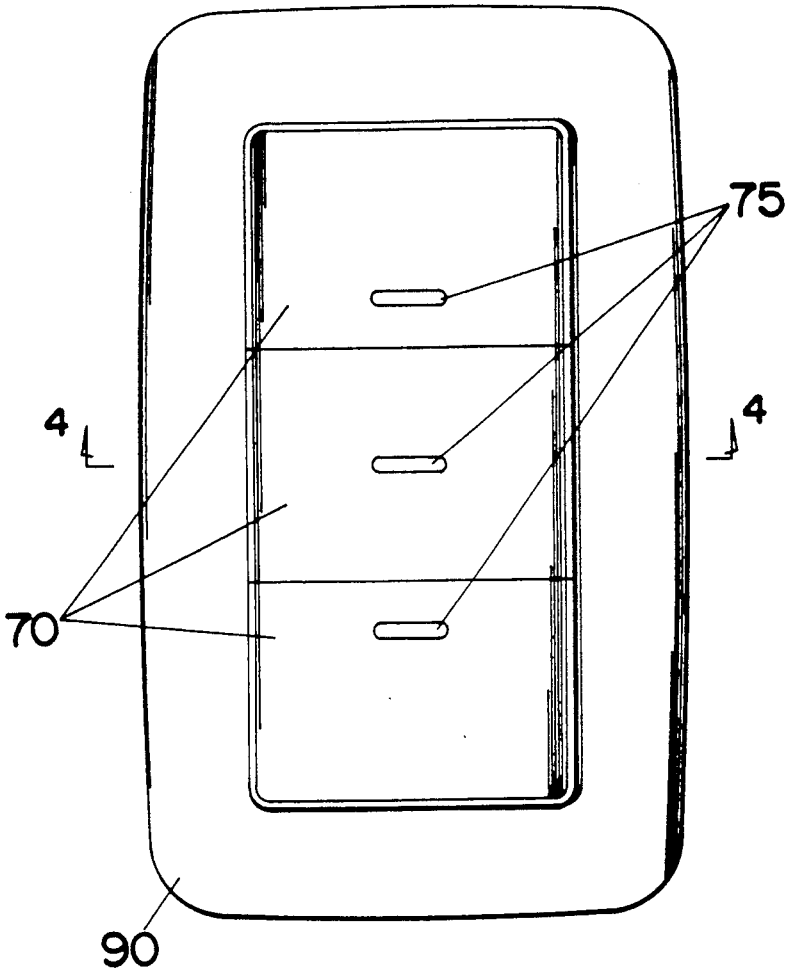
FIG. 2 is a front view of the above switch assembly shown with the cover plate assembly.
Figure 3:
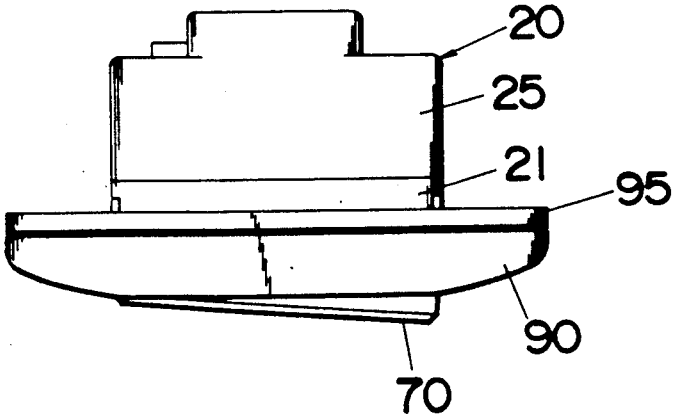
FIG. 3 is a plan view of the above switch assembly with the cover plate assembly.
Figure 4:
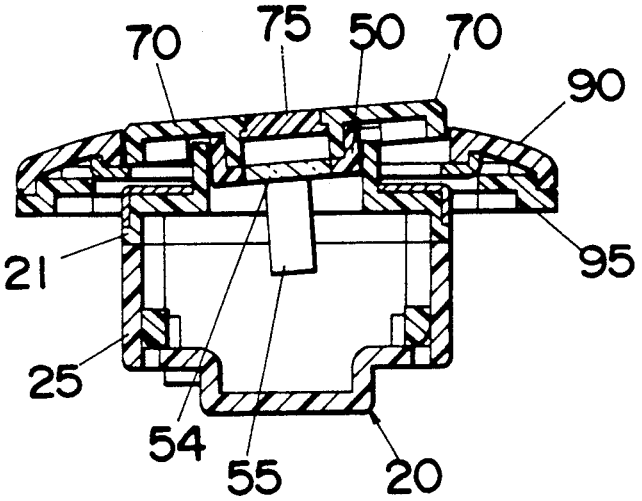
FIG. 4 is a sectional view taken along line 4—4 of FIG. 2.

Fitted within each actuator 50 is a catch spring 60 for detachable connection with each operator handle 70. The catch spring 60 is in the form of a generally U-shaped configuration having opposed legs 61 connected by a horizontal segment 62 with an opening 63 which is in registration with the transparent plate 54 of the actuator 50. At the corners of the horizontal segment 62 there are formed downwardly turned anchor tabs 64 which are respectively press-fitted into corresponding slots 58 in the bottom 53 of the actuator 50 to firmly hold the catch spring 60 within the actuator 50. The catch spring 60 is formed in the opposed legs 61 respectively with dents 65 for detachable snap connection with latch projections 72 formed on the side of the operator handle 70, as shown in FIG. 9. Projecting centrally on the rear of each operator handle 70 is a hollow rectangular plug 71 which fits within the actuator 5c between the opposed legs 61 of the catch spring 60. The above-mentioned latch projections 72 are formed on the opposite end walls of the plug 71. It is noted at this point that the legs of the catch spring 60 are resilient enough to permit their outward flexing by an amount sufficient to pass the corresponding latch projections 72 into the dents 64 when the plug 71 of the operator handle 70 is forced downwardly into the actuator 50, after which the legs 61 will be snapped back or resiliently urged inwardly into locked engagement with the latch projections 72. Thus, the operator handle 70 is easily attached to each of the actuators 50 to be rockable therewith for contact opening and closing. Removal of the operator handle 70 is done by applying a pull force to the operator handle 70 in which the legs 61 of the catch spring 60 flex resiliently outwardly in a like manner to allow the latch projections 72 to be disengaged from the dents 64. Because of the detachable snap connection given to the operator handles 70, the housing 20 of the switch assembly can be installed to the wall Without the operator handles 70 but with the face plate 90, and after Which the operator handles 70 can be assembled through a center opening 91 of the face plate 90. This means that, as shown in FIGS. 1 and 2, the operator handles 70 can be designed into a wide-flat configuration such that they are positioned in a closely adjacent relation to each other for flush arrangement and that they can serve to conceal therebehind screws 92 utilized to fasten the face plate 90 to the mount bracket so. The screws 92 are retained in the face plate 90 and engaged into threaded holes 86 correspondingly formed in the mount bracket so. It is noted in this connection that the face plate 90 can conceal the entire front surface of the plate frame 95, the mount bracket so, and the housing 20 of the switch assembly 10 so as to only dispose the operator handles 70, which gives rise to an aesthetically pleasing appearance.

The plug 71 of each operator handle 70 is also formed on the opposed side wall with positioning projections 73 which engage respectively into corresponding notches 59 formed in the upper ends of the opposed side walls 51 of the actuator 50 for exact positioning of the operator handle 70 with respect to the actuator 50, thereby eliminating any undesirable angular displacement of the operator handle 70 about an upright axis. Thus, the operator handles 70 can be kept in an exact position and be free from jamming in their rocking movement even when they are designed into large dimensions to such an extent that they are arranged closely to each other, as shown in FIGS. 1 and 2. A transparent piece 75 is fitted within the plug 71 with a top lens portion penetrating the operator handle 70 to define thereat a transparent window which is vertically aligned with the bottom opening of the catch spring 60 and the transparent plate 54 in the bottom of the actuator 50 such that the light from the neon lamp 41 and/or the LED 42 can be viewed therethrough for confirmation of specific condition of an electric circuit in which the switch is connected.

What is claimed is:

1. A multi-unit switch assembly comprising:

a single housing which is divided into a plurality of compartments respectively accommodating therein a corresponding number of switch mechanisms, each switch mechanism having a movable contact and at least one stationary contact; an actuator rockably mounted within said housing to move said movable contact into and out of contact engagement with at least one stationary contact, said actuator having a spring catch;

a plurality of operator handles corresponding in number to the number of said switch mechanisms, each operator handle being located exteriorly of said housing and detachably connected to said actuator of each switch mechanism by snap engagement with said spring catch so that the operator handle is rockable together with said actuator;

a mount bracket for mounting said switch assembly to a fixed wall surface, said mount bracket being secured to the upper surface of said housing and having a window through which said actuators are exposed for snap engagement with the corresponding operator handles;

a face plate placed over said mount bracket and detachably secured to said mounting bracket by fastening means, said face plate having an opening through which said operator handles are detachably coupled to the corresponding actuators, said face plate being formed at corners of said opening with lands for retaining said fastening means, said opening bearing configured such that said operator handles are arranged within said opening in a closely adjacent relation to one another so as to conceal therebehind said lands and fastening means, whereby exposing only the operator handles and said face plate while concealing therebehind said mount bracket, said fastening means, said individual switch mechanisms, and said housing.

2. A multi-unit switch assembly as set forth in claim 1, further including a plate frame detachably fixed and surrounding said mount bracket, said plate frame being located behind said face plate to be fitted on said fixed wall surface.

3. A multi-unit switch assembly as set forth in claim 1, further including an indicator lamp provided in at least one of said switch mechanisms and connected to said contacts for indication of the positon of said contacts, said lamp being supported on a printed board accommodated within said housing such that it is located below said actuator, said actuator having a transparent portion, said operator handle having a transparent window positioned such that said lamp can be viewed through said actuator, and through said transparent window.

4. A multi-unit switch assembly as set forth in claim 3, wherein said actuator is in the form of an opened top rectangular frame having opposed side walls, opposed end walls, and a bottom wall with said transparent portion, said spring catch being of generally U-shaped configuration comprising a pair of legs connected by a flat member with an opening therein defining a transparent portion, said spring catch being fitted within said actuator with said transparent portions thereof being in registration with each other and with said flat member secured to said bottom wall, each of said legs being formed with a detent for said snap engagement with a latch projection formed on the bottom of each operator handle.

5. A multi-unit switch assembly as set forth in claim 1, wherein said operator handles, each in the form of a flat plate, are closely arranged in substantially the same plane in closely adjacent relation to one another in order to conceal said housing and said switch mechanisms therebehind.

6. A multi-unit switch assembly as set forth in claim 1, wherein said operator handles, each in the form of a flat plate, are closely arranged in substantially the same plane in a closely adjacent relation to one another in order to leave no substantial gap between the adjacent edges thereof.

7. A multi-unit switch assembly as set forth in claim 1, wherein said housing 20 is composed of a base body and a top cover between which said switch mechanisms are received with each of said spring catch being exposed on the upper surface of said top cover, said mount bracket being placed on said top cover and secured to said base body by fastening means so as to hold said top cover between said base body and the mount bracket.

* * * * *